United States Patent [19]

Fry

[11] Patent Number: 4,840,547

[45] Date of Patent: Jun. 20, 1989

[54] COMPRESSOR INCLUDING PROTECTIVE CAP FOR HERMETIC TERMINAL

[75] Inventor: Emanuel D. Fry, Tecumseh, Mich.

[73] Assignee: Tecumseh Products Company, Tecumseh, Mich.

[21] Appl. No.: 230,578

[22] Filed: Aug. 10, 1988

[51] Int. Cl.[4] ..... F04B 35/04; H01R 13/44

[52] U.S. Cl. ..... 417/422; 174/138 F; 215/320; 417/902; 439/149; 439/892

[58] Field of Search ..... 174/138 F, 152 GM; 150/52 R; 215/320; 310/71; 411/373; 417/902, 422; 439/135, 149, 150, 367, 519, 521, 528, 685, 718, 892, 893, 926, 935

[56] References Cited

U.S. PATENT DOCUMENTS

| | | | |
|---|---|---|---|
| 632,695 | 9/1899 | Butler | 138/96 R X |
| 1,406,133 | 2/1922 | Wright | 138/96 T X |
| 2,337,781 | 12/1943 | Stoker | 174/74 A |
| 2,825,880 | 3/1958 | Wechsler | 439/892 |
| 3,022,936 | 2/1962 | Connor | 417/902 X |
| 3,107,132 | 10/1963 | Smith | 439/135 |
| 3,160,175 | 12/1964 | Laemmle | 138/109 |
| 3,287,687 | 11/1966 | Mosher | 439/135 |
| 3,327,280 | 6/1967 | Levine et al. | 439/135 |
| 3,350,044 | 10/1967 | Zulauf | 138/96 R X |
| 3,427,550 | 2/1969 | Helda et al. | 439/149 |
| 3,548,704 | 12/1970 | Kutryk | 411/373 |
| 3,814,135 | 6/1974 | Hetzer et al. | 138/89 |
| 3,902,629 | 9/1975 | Kushner | 417/902 X |
| 4,333,698 | 6/1982 | Herbert | 439/135 |
| 4,365,858 | 12/1982 | Karol | 439/135 |
| 4,406,506 | 9/1983 | Baldwin | 439/135 |

FOREIGN PATENT DOCUMENTS

| | | | |
|---|---|---|---|
| 36391 | 8/1926 | Denmark | 215/320 |
| 809091 | 7/1951 | Fed. Rep. of Germany | 215/320 |
| 1807093 | 5/1970 | Fed. Rep. of Germany | 174/138 F |
| 662433 | 5/1979 | U.S.S.R. | 215/320 |
| 527930 | 10/1940 | United Kingdom | 439/135 |

OTHER PUBLICATIONS

Advertisement: "Caplugs", *Electronic Products*, Dec. 1961, p. 15.

*Primary Examiner*—Laramie E. Askin

*Attorney, Agent, or Firm*—Albert L. Jeffers; John F. Hoffman; David L. Ahlersmeyer

[57] ABSTRACT

A protective cap for the hermetic terminal of a hermetic compressor includes a cup-shaped plastic member for attaching to and covering the hermetic terminal during manufacturing, shipping, and storage of the compressor, i.e., whenever the hermetic terminal would not otherwise be connected to an external source of power. The cap contactingly engages the base portion and conducting pins of the hermetic terminal. The protective cap includes a cylindrical stud portion arranged coaxially within an outer cylindrical wall portion of the cup-shaped member. The stud portion slip fits radially inwardly of the circularly arranged conductor pins of the hermetic terminal. A tapered end facilitates guided insertion of the stud portion within the conductor pins prior to engagement of the cap with the hermetic terminal base portion.

20 Claims, 2 Drawing Sheets

COMPRESSOR INCLUDING PROTECTIVE CAP FOR HERMETIC TERMINAL

BACKGROUND OF THE INVENTION

The present invention relates generally to hermetic compressors of the type having a hermetic housing, wherein a hermetic terminal is provided for carrying electrical current into the housing and, more particularly, to a protective cap for temporary placement over the hermetic terminal on the exterior of the housing when the hermetic compressor is not otherwise operably connected to a source of power.

Typically, a hermetic electrical terminal is installed in a hole formed in the housing of a hermetic compressor so that current may be carried to the compressor motor from an external power source. The terminal comprises a body member welded or otherwise secured to the compressor outer housing, and a plurality of conductor pins secured to and extending through the body member. The portion of the conductor pins on the exterior of the compressor housing must remain clean and undamaged during manufacturing, shipping, and storage of the compressor in order to insure a reliable connection of a plug or individual wires to the terminals when the compressor is installed.

Methods for protecting the hermetic terminal of an installed compressor from damage are known, and include providing an upwardly extending wall, or fence, around the hermetic terminal. Such a wall generally comprises a formed piece of metal welded to the exterior wall of the compressor housing, thereby leaving a top opening which must then be covered with a combination cover piece and retaining clip. Another protective cover design involves having a cover member received onto a threaded stud welded to the compressor housing in close proximity to the hermetic terminal, and retained thereon by a threaded nut or the like. Both of these approaches to protecting the hermetic terminal are effective, but may be deemed too substantial and costly for applications wherein only a temporary protective cover is desired for the hermetic terminal prior to installation of the compressor.

A simple, cup-shaped plastic cap has been used for temporary protection of the hermetic terminal during manufacturing, shipping, and storage of compressors, wherein an open end of the cap fits over and frictionally engages the base portion of the terminal body adjacent the compressor housing wall. The conducting pins of the terminal are housed within the hollow cup-shaped cap in spaced relationship therewith. With only one point of attachment at the base of the terminal body, the cap pops off, or becomes disengaged from the hermetic terminal when only a slight lateral force is applied to the unattached closed end of the cup-shaped cap, such as might likely occur during handling of the compressor prior to installation.

Accordingly, it is desired to provide an improved protective cap for temporary protection of the hermetic terminal of a hermetic compressor during handling of the compressor prior to operable installation, wherein the cap is not susceptible to becoming disengaged from the terminal by slight lateral forces applied to the closed end of the cap.

SUMMARY OF THE INVENTION

The present invention provides a protective cap for the hermetic terminal of a hermetic compressor, wherein the cap contactingly engages the hermetic terminal at two spaced locations, thereby preventing the protective cap from becoming inadvertently disengaged from the hermetic terminal in response to a substantially lateral force being applied to the cap.

In general, the invention provides a cup-shaped cap having an open end, a closed end, and a generally cylindrical wall therebetween. The open end attaches to a base portion of the hermetic terminal adjacent the compressor housing, whereby he cap fits over the terminal and the outwardly extending conductor pins of the terminal are housed within the cup-shaped cap. The invention, in one form thereof, provides for the closed end of the cup-shaped cap to contactingly engage the conductor pins within, whereby the cap contacts both the base portion and the conductor pins of the hermetic terminal to resist disengagement.

More specifically, the invention provides, in one form thereof, a cup-shaped cap, wherein a generally cylindrical stud portion is attached to the closed end of the cap and extends coaxially within the cap in spaced relationship with the cylindrical sidewall thereof. When the hermetic terminal includes a plurality of circularly arranged conductor pins, the stud portion of the cap is snugly fit radially inwardly of the conductor pins in contacting engagement therewith. When the cap is installed axially onto the hermetic terminal, the stud portion contactingly engages the conductor pins prior to the open end contactingly engaging the base portion of the terminal.

An advantage of the protective cap of the present invention is that the cap is not easily inadvertently disengaged from the hermetic terminal due to lateral forces, yet is easily installed and removed by an operator imparting inward and outward movement to the cap relative to the compressor housing wall.

Another advantage of the protective cap of the present invention is that hermetic terminals of hermetic compressors are more effectively protected during the period of time prior to operable installation of the compressor.

A further advantage of the protective cap of the present invention is that temporary protection of the hermetic terminal of a compressor is accomplished effectively and inexpensively.

A still further advantage of the protective cap of the present invention is that more substantial, costlier methods of protecting hermetic terminals need not be incorporated into the compressor design where the final installation environment does not require them.

Another advantage of the protective cap of the present invention is that the cap may be easily molded out of plastic, such as polyethylene or the like.

Yet another advantage of the protective cap of the present invention is that exact axial alignment of the cap and terminal conductor pins is not required during placement of the cap onto the terminal.

The invention, in one form thereof, provides a hermetic compressor including a housing having an opening therein. An electric motor is operatively disposed within the housing. The compressor also includes a hermetic terminal for carrying electric current from an external source of power to the motor within the housing. The hermetic terminal comprises a body member closing the housing opening, and a plurality of current conducting pins passing through the body member. Each pin includes an upwardly extending portion on the exterior of the housing. A protective cap is provided, which contacts the body member and the upwardly extending portions of the current conducting pins. The cap covers the hermetic terminal on the exterior of the housing when the compressor is not otherwise operably connected to an external source of power. In one form of the invention, the conducting pins are circularly arranged, each having a radially inwardly facing surface against which a generally cylindrical stud portion of the protective cap contacts.

The invention further provides, in one form thereof, a protective cap for temporarily covering the hermetic terminal of a hermetic compressor when the hermetic terminal is not otherwise connected to an external source of power. The hermetic terminal includes a base portion and at least three circularly arranged conductor pins extending upwardly, parallel to one another, from the base portion on the exterior of compressor housing. The protective cap comprises a cup-shaped body member, including an open end, a closed end, and a generally cylindrical sidewall therebetween. The open end is adapted to fit circumjacent the hermetic terminal base portion. The cap also comprises a generally cylindrical stud portion having an attached end and an opposite unattached end. The attached end is attached to the body member closed end, whereby the stud portion is disposed substantially coaxially within the body member is spaced relationship with the sidewall. The unattached end is adapted to fit radially inwardly of the circularly arranged conductor pins in contacting engagement therewith. In one aspect of the invention according to this form thereof, the unattached end terminates in a taper to provide guided insertion of the unattached end inwardly of the conductor pins. In another aspect of the invention, the protective cap is of plastic material, and the stud portion is generally hollow. In accordance with yet another aspect of the invention, the stud portion becomes operatively engaged with the conductor pins prior to the open end becoming operatively engaged with the base portion during axially inward movement of the protective cap onto the hermetic terminal.

The invention still further provides, in one form thereof, a protective cap for a hermetic compressor, wherein the compressor includes an outer housing having an opening therein in which a hermetic terminal is mounted to provide an electrical connection between an external source of power and a motor within the housing. The hermetic terminal includes a base portion adjacent the housing wall and a plurality of axially outwardly extending conductor pins. The protective cap temporarily covers the hermetic terminal before the compressor is operably installed, at which time the protective cover is removed and the hermetic terminal is connected to an external source of power. The protective cap, in accordance with one form of the invention, includes a cover for covering the hermetic terminal on the exterior of the compressor housing. Additionally, the cap includes a first attachment mechanism for providing contacting engagement between the cover and the base portion of the hermetic terminal. A second attachment mechanism provides contacting engagement between the cover and the conductor pins of the hermetic terminal. The first and second attachment mechanisms are selectively engaged and disengaged with the hermetic terminal in response to axially inward and outward movement of the cover relative to the compressor housing wall, whereby the protective cap is prevented from becoming inadvertently disengaged from the hermetic terminal in response to a lateral force being applied to the cover. In one aspect of the invention, the second attachment mechanism becomes operatively engaged with the conductor pins prior to the first engagement mechanism becoming operatively engaged with the base portion during axially inward movement of the protective cap.

DESCRIPTION OF THE PREFERRED EMBODIMENT

Figure 1:
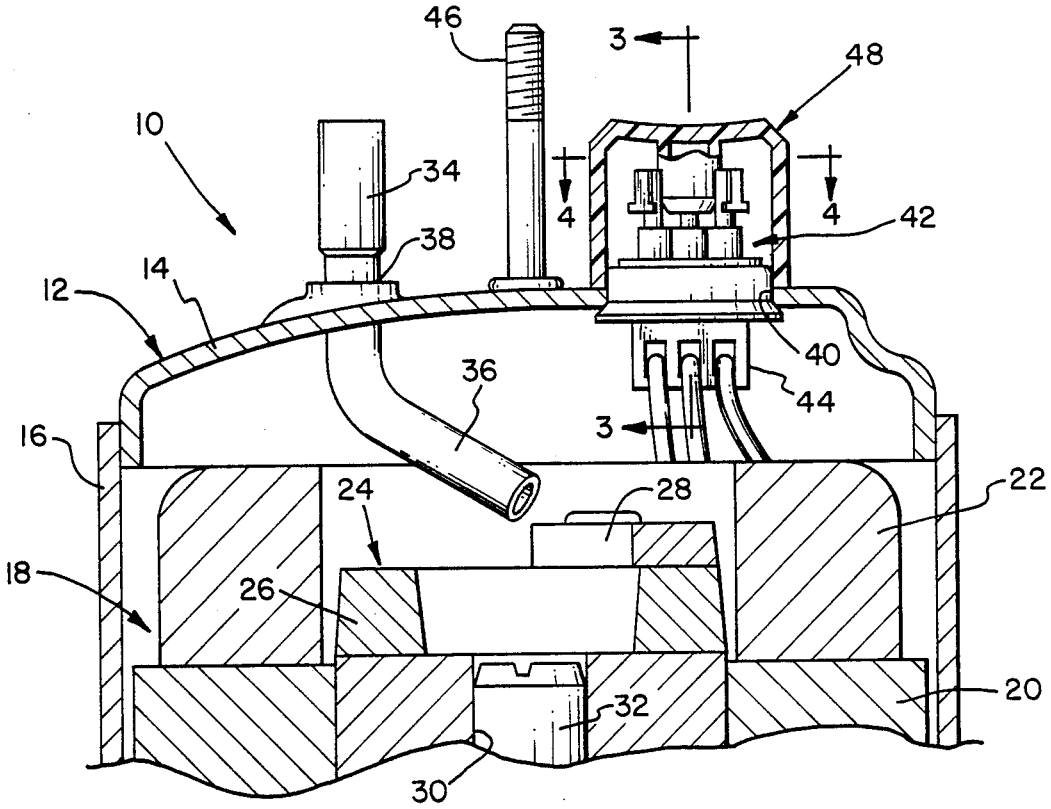
FIG. 1 is a fragmentary cut-away, partially sectioned view of a hermetic compressor, including a hermetic terminal provided with a protective cap in accordance with the present invention.

In an exemplary embodiment of the invention as shown in the drawings, and in particular by referring to FIG. 1, a hermetic compressor 10 is shown having a housing generally designated at 12. Housing 12 comprises a top portion 14, a central portion 16, and a lower portion (not shown). The three housing portions are hermetically secured together as by welding or brazing. Disposed within housing 12 is an electric motor generally designated at 18. Motor 18 comprises a stator 20 having windings 22, and a rotor 24 having an end cap 26 to which a counterweight 28 is attached. The stator is secured to housing 12 by an interference fit such as by shrink fitting.

Rotor 24 has a central aperture 30 provided therein into which is secured a rotatable crankshaft 32 by an interference fit. Crankshaft 32 is drivingly connected to a compressor mechanism (not shown), e.g., a reciprocating piston or rotary vane compressor, which compresses refrigerant for discharge into the interior of housing 12. A refrigerant discharge tube 34 extends through top portion 14 of the housing and has an end 36 thereof extending into the interior of the compressor housing as shown. The tube is sealingly connected to housing 12 at 38, as by soldering.

Top portion 14 includes an opening 40 in which is provided a hermetic terminal assembly 42 for carrying electrical current from outside of housing 12 to motor 18 when compressor 10 is operably connected to an external power source (not shown). An electrical plug and wiring assembly 44 connects to terminal assembly 42 on the interior of the housing and carries current to stator windings 22. Compressor 10 also includes a post 46 welded to top portion 14 for mounting a terminal cover (not shown) to cover terminal assembly 42 once compressor 10 is operably installed. In accordance with the principles of the present invention, a protective cap 48 is shown removably attached to terminal assembly 42, whereby cap 48 temporarily covers terminal assembly 42 during manufacturing, shipping, and storage of compressor 10, i.e., whenever terminal assembly 42 is not otherwise connected to an external source of power.

Figure 3:
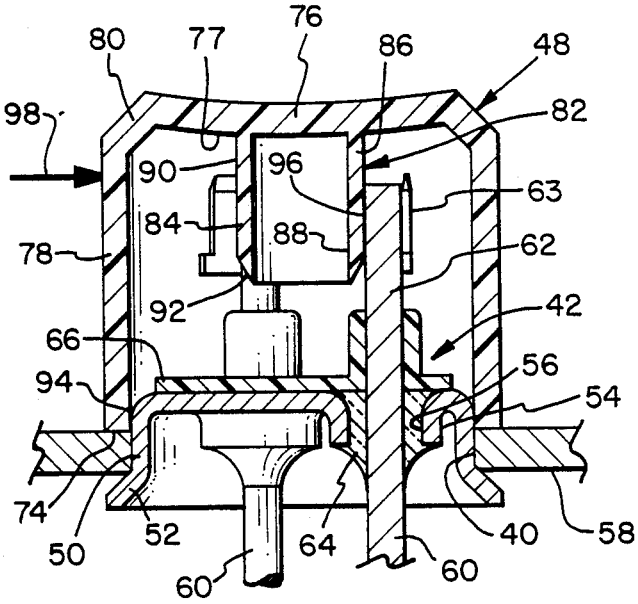
FIG. 3 is an enlarged fragmentary sectional view of the hermetic terminal and protective cap of the compressor of FIG. 1, taken along the line 3—3 in FIG. 1 and viewed in the direction of the arrows.
Figure 4:
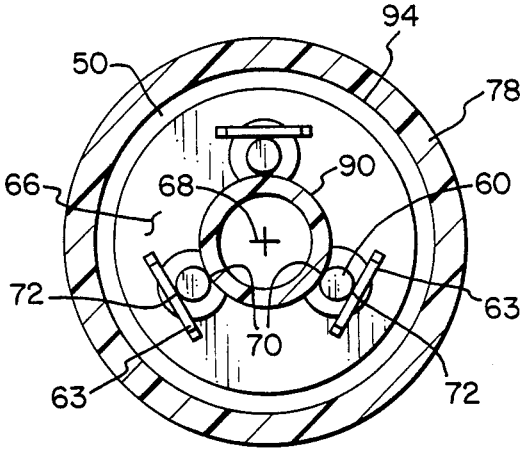
FIG. 4 is a transverse sectional view of the hermetic terminal and protective cap of FIG. 3, taken along the line 4—4 in FIG. 1 and viewed in the direction of the arrows.
Figure 2:
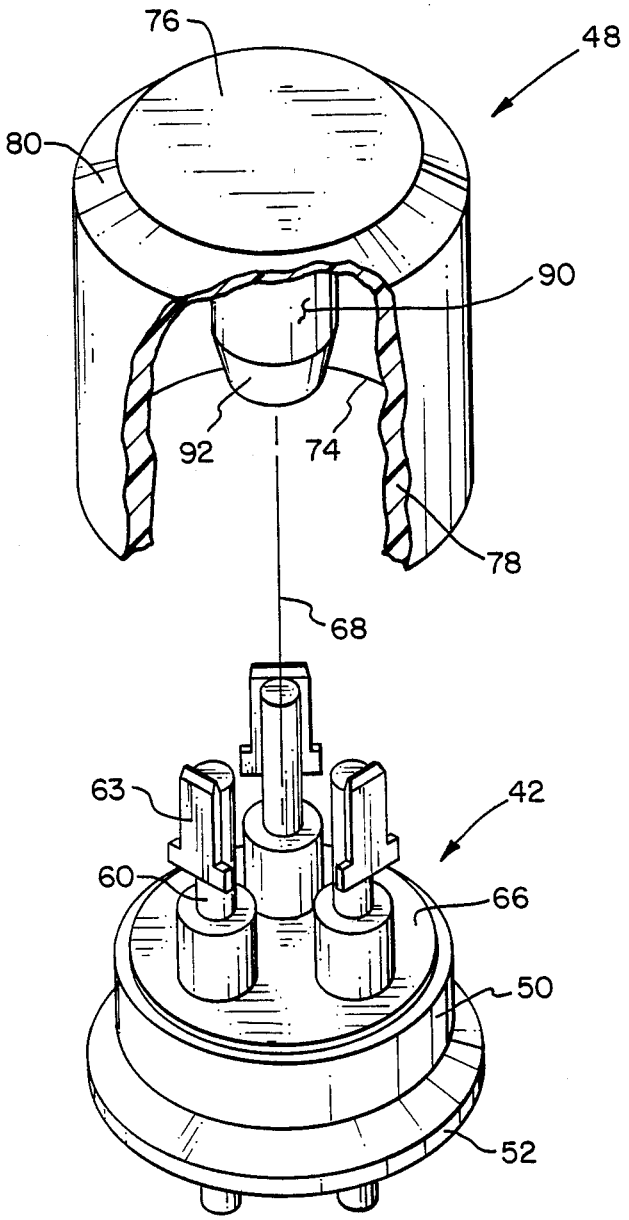
FIG. 2 is an enlarged exploded view of the hermetic terminal and protective cap of the compressor of FIG. 1, particularly showing a cut-away view of the protective cap to reveal the stud portion thereof.

Referring now to FIGS. 2–4, terminal assembly 42 comprises a metallic, cup-shaped body member 50 having a round flange 52 and three inwardly extending collars 54 defining openings 56 extending through body member 50. Flange 52 is disposed against an inner surface 58 of housing 12 when terminal assembly 42 is welded in place, thereby ensuring that the body member 50 will not be dislodged by the high pressure within housing 12. Received in each of the collars 54 is a metallic conductor pin 60 made of a suitable conducting material, such as stainless steel, copper, or copper core stainless steel. Pins 60 are preferably of integral construction, each having an upwardly extending portion 62 on the outside of housing 12 for connection to an external source of power. A tab 63 is secured to the distal end of each portion 62 in order to facilitate the attachment of connecting leads (not shown).

Each pin 60 is retained within an opening 56, and is spaced from a collar 54 by an insulating material 64, such as glass, epoxy, or some other suitable material. Also, the external surface of body member 50 is coated with a suitable epoxy 66, which extends partially along pin portions 62, as shown in the drawings. As best illustrated in FIGS. 2 and 4, pins 60 are circularly arranged about a central axis 68 extending generally normal to the outside surface of housing 12. Central axis 68 is represented by a line in FIG. 2 and a cross in FIG. 4. Portions 62 of pins 60 extend axially upwardly, parallel to one another and to central axis 68. Accordingly, each pin portion 62 includes a radially inner side 70 facing central axis 68, and a radially outer side 72 to which tab 63 is attached, as shown in FIG. 4.

Referring once again to FIGS. 2–4 for a description of protective cap 48 in accordance with a preferred embodiment of the preent invention, cap 48 is a generally cup-shaped, molded piece of polyethylene, comprising a circular open end 74, a closed end 76, and a cylindrical sidewall 78 extending therebetween. In the illustrated embodiment, cap 48 includes an annular bevelled portion 80 intermediate closed end 76 and a sidewall 78. Also, closed end 76 is slightly concave inwardly. These particular design features improve the manufacturability of cap 48, i.e., make it easier to mold, and improve the aesthetic appearance of the cap. Additionally, bevelled portion 80 eliminates a sharp corner that might otherwise become bumped or make the cap more difficult to grasp.

Cap 48 includes a hollowed, cylindrical stud member 82, comprising a cylindrical body portion 84 having a proximal end 86 integrally atttached to an inside surface 77 of closed end 76, and a distal end 88 located at the approximate midpoint between closed end 76 and open end 74. Body portion 84 extends coaxially within sidewall 78, and includes a cylindrical outer surface 90 spaced equidistant from sidewall 78. A taper 92 is provided in body portion 84 at distal end 88, the purpose of which will be more fully descibed hereinafter.

In operation, protective cap 48 is installed onto and removed from terminal assembly 42 by moving the cap axially inwardly and outwardly along axis 68, respectively, as illustrated in FIG. 2. More specifically, cap 48 is placed over terminal assembly 42 by directing stud member 82 to be received within the void defined radially inwardly of circularly arranged pin portions 62. Taper 92 on stud member 82 helps guide the stud member radially inwardly of pin portions 62, thereby obviating the need for precise axial alignment between cap 48 and terminal assembly 42 initially during installation.

In the preferred embodiment of the invention, cap 48 is operably retained on terminal assembly 42 by means of contacting engagement therebetween at two separate locations. At a first location, open end 74 fits circumjacent body member 50, resulting in a continuous annular interface 94 therebetween. At a second location, cylindrical body portion 84 is received intermediate pin portions 62, whereby cylindrical outer surface 90 contacts radially inner sides 70 of pin portions 62 at line interfaces 96 therebetween. In order to avoid radially outward deflection of pin portions 62, it is preferred that the diameter of body portion 84 be such as to fit exactly within the void defined by the pins. However, it will be appreciated that the hollow, plastic construction of body portion 84 permits some radially inward deflection thereof by pin portions 62, if necessary. Incidentally, the hollowed construction also facilitates easier and more economical molding of protective cap 48.

In the design of cap 48, in accordance with the preferred embodiment of the invention, the axial distance of annular interface 94 is less than that for the line interface 96. As a result, the engagement of body portion 84 with pin portions 62 occurs prior to the engagement of open end 74 with body member 50 during installation of the cap onto the terminal. Accordingly, the cap may be tilted slightly to initially engage the stud member prior to axially aligning the cap and moving it axially downwardly onto the terminal base.

A primary advantage of the present invention resides in the provision of two locations of attachment of the protective cap to the terminal assembly, i.e., one at the base of the terminal adjacent the housing and the other at the conductor pins spaced outwardly from the base. Consequently, the contacting engagement between the cap and terminal at these locations need not be as strong as would otherwise be required in the case of attachment only at the base. More importantly, a protective cap in accordance with the present invention is less susceptible to being popped off, or disengaged, as the result of a lateral force being applied to the cap, as illustrated by arrow 98 in FIG. 3.

It will be appreciated that the foregoing is presented by way of illustration only, and not by way of any limitation, and that various alternatives and modifications may be made to the illustrated embodiment without departing from the spirit and scope of the invention.

What is claimed is:

1. A hermetic compressor, comprising:

a housing having an opening therein;

an electric motor operatively disposed within said housing;

hermetic terminal means for carrying electric current from an external source of power to said motor within said housing, said terminal means comprising a body member closing said housing opening, and a plurality of current conducting pins passing through said body member and having upwardly extending side portions on the exterior of said housing; and protective cap means, contacting said body member and said upwardly extending side portions of said plurality of conducting pins, for covering said terminal means on the exterior of said housing when said compressor is not operably connected to an external source of power.

2. The compressor of claim 1 in which:
said upwardly extending side portions are circularly arranged, each having a radially inwardly facing surface against which said protective cap means contacts.

3. The compressor of claim 2 in which:
said protective cap means includes a generally cylindrical stud portion received radially inwardly of said upwardly extending side portions in contacting engagement therewith.

4. The compressor of claim 1 in which:
said body member includes a round base portion adjacent said housing, and said upwardly extending side portions are circularly arranged; and
said protective cap means includes a first portion circumjacent said base portion in contacting engagement therewith, and a second portion about which said upwardly extending side portions are arranged in contacting engagement therewith.

5. The compressor of claim 1 in which:
said upwardly extending side portions extend axially outwardly from the outer wall of said housing; and
said protective cap means comprises first attachment means for providing contacting engagement between said protective cap means and said body member, and second attachment means for providing contacting engagement between said protective cap means and said upwardly extending side portions, said first and second attachment means being selectively engaged and disengaged with said hermetic terminal means in response to axially inward and outward movement of said protective cap means relative to said housing outer wall, whereby said protective cap means is prevented from becoming inadvertently disengaged from said hermetic terminal means in response to a lateral force being applied to said protective cap means.

6. The compressor of claim 5 in which:
said second attachment means is operable during at least an equal range of axial movement of said protective cap means as is said first attachment means.

7. The compressor of claim 5 in which:
said second attachment means becomes operatively engaged with said hermetic terminal means prior to said first attachment means becoming operatively engaged therewith during axially inward movement of said protective cap means.

8. In combination with a hermetic compressor having a sealed housing and a hermetic terminal including a base portion and at least three circularly arranged conductor pins extending upwardly, parallel to one another, from the base portion on the exterior of the housing, a protective cap on said hermetic terminal for temporarily covering the hermetic terminal when it is not otherwise connected to an external source of power, such as during manufacturing, shipping, and storage of the compressor, said protective cap comprising:
a cup-shaped body member, including an open end, a closed end, and a generally cylindrical sidewall therebetween, said open end being disposed circumjacent the hermetic terminal base portion; and
a generally cylindrical stud portion having an attached end and an opposite unattached end, said attached end being attached to said body member closed end, said stud portion being disposed substantially coaxially within said body member in spaced relationship with said sidewall, said unattached end being disposed radially inwardly of the circularly arranged conductor pins in contacting engagement therewith.

9. The combination of claim 8 in which:
said unattached end terminates in a narrowing taper to provided guided insertion of said unattached end inwardly of the conductor pins.

10. The combination of claim 8 in which:
said protective cap comprises plastic material and said stud portion is generally hollow.

11. The combination of claim 8 in which:
said sidewall is spaced radially outwardly from the conductor pins when said protective cap is operatively covering said hermetic terminal.

12. The combination of claim 8 wherein the conductor pins extend axially outwardly from an outer wall of the hermetic compressor housing, in which:
a first axial length of said sidewall at said open end contacts said base portion and a second axial length of said stud portion contacts the conductor pins, said protective cap being constructed such that said first axial length is less than said second axial length.

13. The combination of claim 8 in which:
said open end and said stud portion are selectively engaged and disengaged with said hermetic terminal means in response to axially inward and outward movement of said protective cap relative to an outer wall of the hermetic compressor housing, whereby said protective cap is prevented from becoming inadvertently disengaged from said hermetic terminal means in response to a lateral force being applied to said protective cap.

14. The combination of claim 13 in which:
said stud portion becomes operatively engaged with the conductor pins prior to said open end becoming operatively engaged with the base portion during axially inward movement of said protective cap.

15. In a hermetic compressor including an outer housing having an opening therein in which a hermetic terminal is mounted to provide an electrical connection between an external source of power and a motor within the housing, the hermetic terminal including a base portion adjacent the housing wall and a plurality of axially outwardly extending conductor pins having side portions, a removable protective cap for temporarily covering the hermetic terminal before the compressor is operably installed, at which time said protective cover is removed and the hermetic terminal is connected to an external source of power, said protective cap comprising:
cover means for covering the hermetic terminal on the exterior of the compressor housing;
first attachment means for providing contacting engagement between said cover means and the base portion of the hermetic terminal; and
second attachment means for providing contacting engagement between said cover means and the side portions of said conductor pins of the hermetic terminal, said first and second attachment means being selectively engaged and disengaged with the hermetic terminal in response to axially inward and outward movement of said cap relative to the compressor housing wall, whereby said protective cap is prevented from becoming inadvertently disengaged from the hermetic terminal in response to a lateral force being applied to said protective cap.

16. The compressor of claim 15 in which:

the conductor pins are circularly arranged, each side portion having a radially inwardly facing surface with which said second attachment means contactingly engages.

17. The compressor of claim 16 in which:

said second attachment means comprises a generally cylindrical stud portion received radially inwardly of the conductor pins in contacting engagement therewith.

18. The compressor of claim 15 wherein the conductor pins are circularly arranged, in which:

said cover means comprises a cup-shaped body member, including an open end, a closed end, and a generally cylindrical sidewall therebetween, said open end being adapted to fit circumjacent the hermetic terminal base portion; and said second attachment means comprises a generally cylindrical stud portion having an attached end and an opposite unattached end, said attached end being attached to said body member closed end, said stud portion being disposed substantially coaxially within said body member in spaced relationship with said sidewall, said unattached end being adapted to fit radially inwardly of the circularly arranged conductor pins in contacting engagement therewith.

19. The compressor of claim 18 in which:

said unattached end terminates in a narrowing taper to provided guided insertion of said unattached end inwardly of the conductor pins.

20. The compressor of claim 15 in which:

said second attachment means becomes operatively engaged with the conductor pins prior to said first engagement means becoming operatively engaged with the base portion during axially inward movement of said protective cap.

* * * * *